United States Patent [19]

Newsom

[11] Patent Number: 5,035,098

[45] Date of Patent: Jul. 30, 1991

[54] CONTAINER BLOCK

[75] Inventor: Bob G. Newsom, Etty, Ky.

[73] Assignee: Advanced Building Technologies, Inc., Olive Hill, Ky.

[21] Appl. No.: 548,373

[22] Filed: Jul. 5, 1990

Related U.S. Application Data

[63] Continuation-in-part of Ser. No. 484,401, Feb. 26, 1990, which is a continuation-in-part of Ser. No. 246,261, Sep. 20, 1988, Pat. No. 4,903,453.

[51] Int. Cl.[5] ..... E04C 3/00

[52] U.S. Cl. ..... 52/589; 52/421; 52/576

[58] Field of Search ..... 52/415, 424, 429, 378, 52/648, 593, 589, 421, 439, 743, 576, 577, 306, 307, DIG. 9

[56] References Cited

U.S. PATENT DOCUMENTS

| | | | |
|---|---|---|---|
| 1,451,340 | 4/1923 | Kroonen | 52/429 |
| 1,733,169 | 10/1929 | Purdy | 52/648 |
| 1,889,547 | 11/1932 | Green | 52/415 |
| 2,045,033 | 6/1936 | Kissinger | 52/421 |
| 2,049,907 | 8/1936 | Hess . | |
| 2,086,185 | 7/1937 | Keaney | 52/306 |
| 2,157,688 | 5/1939 | Cascio | 52/378 |
| 2,933,166 | 4/1960 | Castaine | 52/582 |
| 3,180,000 | 4/1965 | Persak Jr. | 52/307 X |
| 3,720,022 | 3/1973 | Dattner | 52/79 |
| 3,744,194 | 7/1973 | Ramberg | 52/378 |
| 3,878,661 | 4/1975 | Moore | 57/DIG. 9 X |
| 3,979,870 | 9/1976 | Moore | 52/576 X |
| 4,057,946 | 11/1977 | Barrett | 52/DIG. 9 X |
| 4,227,357 | 10/1980 | Newsom | 52/344 |
| 4,270,329 | 6/1981 | Moore | 52/576 |
| 4,341,050 | 7/1982 | Long | 52/589 |
| 4,516,375 | 5/1985 | Pagano et al. | 52/650 |
| 4,782,637 | 11/1988 | Erikkson et al. | 52/648 |
| 4,825,620 | 5/1989 | Johnson | 52/648 X |
| 4,903,453 | 2/1990 | Newsom | 52/648 |

FOREIGN PATENT DOCUMENTS

| | | | |
|---|---|---|---|
| 405388 | 8/1943 | Italy . | |
| 530372 | 8/1955 | Italy | 52/79.1 |

*Primary Examiner*—David A. Scherbel
*Assistant Examiner*—Creighton Smith
*Attorney, Agent, or Firm*—Harold Gell

[57] ABSTRACT

A molded container block for fluidic material is fabricated with opposing sides comprised of a plurality of offset parallel planes interconnected to form interfitting geometric surfaces to allow interlocking and nesting of a plurality of container blocks by the geometric shapes of their exterior surfaces. A port allows filling and removal of materials from the container block. It is recessed into a corner of the container block so it will not interfere with the nesting function or detract from the container block structural strength. The shape of the container block is designed to provide nesting of any exterior surface of the container block with a mating exterior surface of a similar container block and to provide rigidity calculated to enable the container block to be used as a structural building unit.

41 Claims, 2 Drawing Sheets

CONTAINER BLOCK

RELATED APPLICATIONS

This is a continuation-in-part of co-pending U.S. patent application Ser. No. 07/484,401 filed Feb. 26, 1990 as a continuation-in-part of U.S. patent application Ser. No. 07/246,261 filed Sept. 20, 1988 by Bob G. Newsom and issued Feb. 27, 1990 as U.S. Pat. No. 4,903,453 for "Construction Blocks".

THE INVENTION

This invention relates to a container configured in the form of a structural building block incorporating interlocking geometric shapes on all sides and the top and bottom.

BACKGROUND OF THE INVENTION

Historically, man has created structures from masonry blocks. This form of building traces its ancestry from the earliest structures which were piles of rock to contemporary cut stone systems and from sun baked brick to the contemporary trend of utilizing kiln fired bricks and cast cement blocks.

Structures utilizing masonry techniques has become increasingly costly due to the labor and energy involved in transporting the materials to the place of construction and erecting the structure. Masonry items such as brick, cut stone or concrete block are extremely heavy and a significant amount of energy is expended transporting them from their place of origin to the building site. Furthermore, skilled masons are required to lay up the building blocks, whether they be brick, stone or cement and mortar is required to secure the blocks together. Thus the cost of a masonry structure is a function considerable energy expended in transporting the materials and a significant amount of skilled labor in handling the mortar and blocks.

A second contemporary means of constructions consists of fabricating a structure from a framework of sawn boards and covering the framework with siding and plaster board type materials. This latter method of construction is not as sturdy as the block construction and like the block system, does not provide adequate thermal insulation. Furthermore, the wooden structure is prone to fire and insect damage and it requires constant maintenance to prevent deterioration.

The obvious shortcomings of the foregoing building methods led to the improved construction method disclosed in U.S. Pat. No. 4,227,357 on "Construction Blocks" issued to Bobby G. Newsom on Oct. 14, 1980. In this system, skeletal blocks formed from heavy gauge rod or bar stock are provided with straight and hook projections that permit the blocks to be interconnected to form a structure which will receive furring strips or stringers. This concept provides a significant advancement to construction methods but fails to provide adequate strength for certain load bearing wall applications. Furthermore, the rods or bars forming the building blocks do not provide a means whereby wall board or other covering materials may be fastened to the structure. In the construction blocks of U.S. Pat. No. 4,227,357, furring strips are necessary to provide a surface for nailing or adhesively affixing materials to the structural wall.

In the co-pending patent applications, structural building blocks or units were configured as containers but the container function was secondary and therefor the resultant blocks were not as utilitarian as required by a dual function device where each function may be considered primary.

OBJECTIVES OF THE INVENTION

It is a primary objective of the present invention to provide a dual use apparatus in the form of a building unit that may serve as a container for fluid materials.

Another objective of the present invention is to provide a beverage container that may be used to fabricate structures after their contents have been removed.

In view of the obvious shortcomings of the various contemporary building methods, it is an objective of this invention to provide a container in the form of a building block which may be assembled by an unskilled laborer without the aid of mortar to create structures having plumb walls and square corners and insulative and structural integrity that is greater than masonry techniques but requires less man power to assemble than a woodframe structure.

A further objective of the present invention is to provide a method for fabricating a structure which includes assembling a number of container blocks comprised of interlocking sides forming male and female coupling means on opposite ends of each container block.

A further objective of the present invention is to provide a method for fabricating a structure which includes assembling a number of container blocks comprised of preformed hollow subassemblies including male and female coupling means on opposite ends and top and bottom of each container block.

A still further objective of the present invention is to provide a building structure comprised of a plurality of interlocking container blocks fabricated by blow molding techniques.

A still further objective of the present invention is to provide a building structure comprised of a plurality of interlocking blocks fabricated from formed plastic sheets arranged to create hollow subassemblies to form construction container block modules.

A still further objective of the present invention is to provide a building structure comprised of a plurality of interlocking container blocks fabricated from cast or molded plastic material shaped to create hollow construction blocks.

It is a further objective of the present invention to provide a building module shaped in the form of a block and incorporate sides, tops and bottoms that will interlock the modules to permit fabricating a structure to meet the needs of the user.

Another objective of the present invention is to provide a method for building a structure comprised of assembling container blocks filled with an insulating material.

A still further objective of the present invention is to provide a method for building a structure comprised of assembling container blocks filled with resinous insulating material and securing facing materials to one side of the modules by nailing the facing materials to the container blocks.

Another objective of the present invention is to provide a method for building a structure comprised of assembling container blocks and securing facing materials to the container blocks by an adhesive means applied to selected flat surfaces of the container blocks.

Another objective of the present invention is to provide a method for building a structure comprised of assembling container blocks and securing facing materials to the container blocks modules by dry wall screws.

A still further objective of the present invention is to provide a building structure comprised of container blocks secured together by adhesive means.

Another objective is to create container blocks of the class described by the preceding objective which are formed by a molding process and have a sufficient wall thickness to provide a degree of thermal insulation.

Another objective is to create structural elements of the class described by the preceding objectives which may be used as toys.

Another objective is to create structural elements of the class described by the preceding objectives which may be used as designers prototype modeling aids.

The foregoing and other objectives of the invention will become apparent in light of the drawings, specification and claims contained herein.

SUMMARY OF THE INVENTION

The present invention is comprised of a beverage container with opposing sides formed with mirror image geometric shapes so that the containers may be interlocked in a side-by-side fashion. The geometric shapes are provided in pairs so that when the containers are turned on their side, they may be interlocked in a staggered fashion and function as structural building units with the left and right sides of the container functioning as the top and bottom of a building block. The top and bottom and front and back of the container (four sides of the building block) are configured in a repeating geometric pattern so that each side contains a interfitting geometry of its opposite side to allow stacking adjacent containers top-to-bottom, front-to-back, back-to-side or front-to-side. In a preferred embodiment, the containers are configures in a two-to-one ratio with the longer sides including two patterns of a short side so that the containers may still be interlocked. When the device is used as a structural unit, the interlocking features of all four sides and top and bottom allow the assembly of a rigid structure without the use of adhesives or bonding materials.

DESCRIPTION OF THE INVENTION

Figure 1:
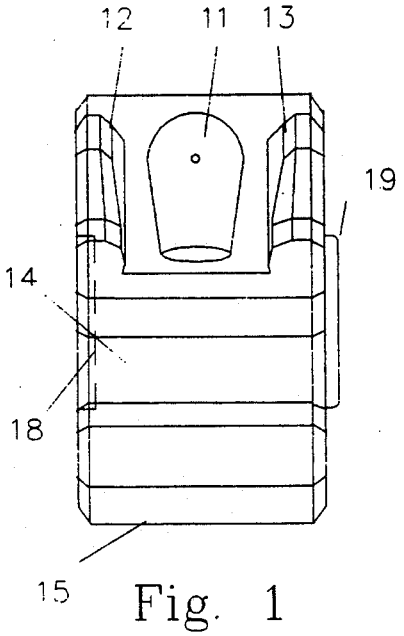
FIG. 1 is a bottom view of a half unit container block.

The half unit container block illustrated in FIG. 1 depicts a push valve dispensing spout 11.

Figure 2:
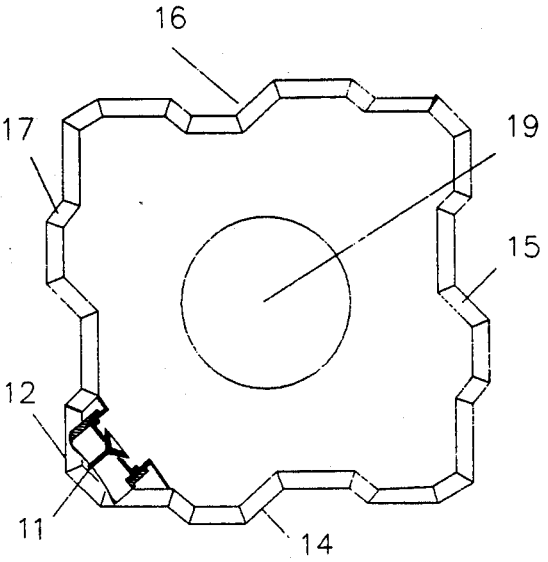
FIG. 2 is a side view of a half unit container block illustrating a geometric configuration for the four sides and top of the half block container unit as it is used for a structural building unit.

FIG. 2 is a side view of the same block with the corner of the block cut away to more clearly illustrate the orientation of the push valve 11. In this view, the container block has been rotated to the pouring configuration. The valve is set at an angle so that it is completely enclosed by the corner projections 12 and 13 of the block.

Figure 5:
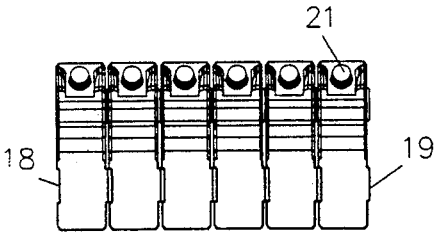
FIG. 5 illustrates a plurality of container blocks nested in a side-by-side orientation for shipping or storage.

In FIGS. 1 and 2, the front 14 of the container block and bottom 15 have identical geometric configurations created by a plurality of offset parallel planes and the back 16 of the container comprises an interfitting surface to the front 14 and top 17 of the container block comprises an interfitting surface to the bottom 15. The cross section geometry of each side is identical when considered in isolation but as the shape is rotated around the construction block, opposite sides become interfitting surfaces. This allows the blocks to be nested in any side/top/bottom orientation. A circular recess 18 is provided on one side of the block in axial alignment with a circular protrusion 19 located on the other side of the block. The depression and protrusion are dimensioned so that they interfit to allow the containers to be nested in a side-by-side relationship as illustrated in FIG. 5.

Figure 3:
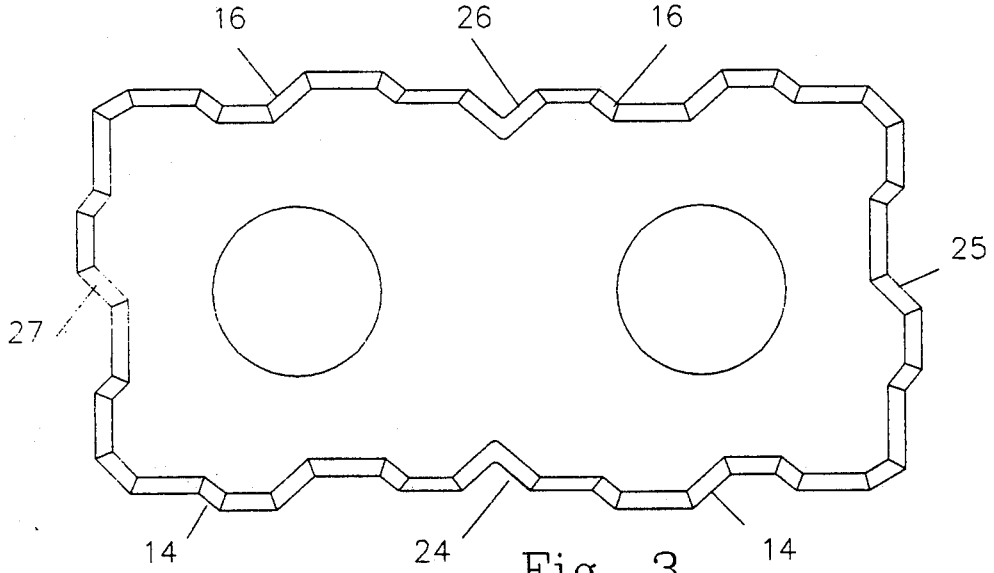
FIG. 3 is a side view of a container block unit illustrating a typical geometric configuration for the four sides and top of the half container block unit as it is used for a structural building unit.

FIG. 3 is a side view of a container block using the two-to-one ratio common in the masonry trade. Note the bottom (right side as illustrated) of this container block is comprised of a section 25 which is shaped identically to the bottom 15 of the container block illustrated in FIG. 2. This shape is repeated around the periphery of the container block in the same fashion as in the half unit container block so that opposite sides of the standard unit container block are interfitting shapes. Thus top 27 of the container block is identical to the top 17 of the half unit container block illustrated in FIG. 2 to create an interfitting surface for the bottom 25. The back 26 (top as illustrated) of the container block is comprised of two sections identical to the back 16 of FIG. 2. The front 24 of the container block is comprised of two sections identical to the front 14 of the half unit container block.

Figure 4:
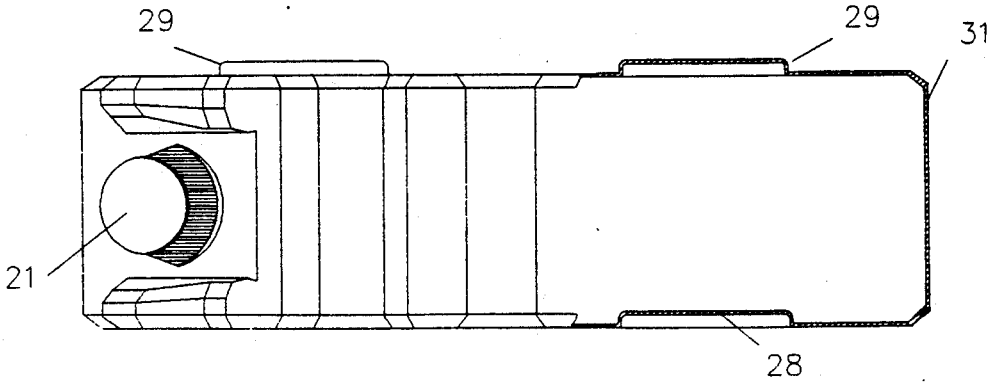
FIG. 4 is a bottom view of a block container unit.
Figure 7:
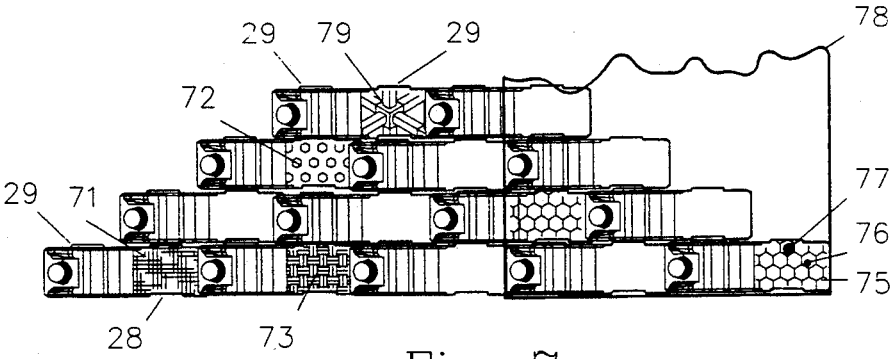
FIG. 7 illustrates the vertical nesting or interfitting of the container blocks when used as structural building units.

The container block illustrated in FIGS. 3 and 4 includes two depressions 28 and two projections 29 dimensioned identically to the depressions 18 and projections 19 of the half unit container block illustrated in FIGS. 1 and 2. The positioning of the depressions and projections are such that three or more blocks may be interlocked in a staggered arrangement as illustrated in FIG. 7 when the container blocks are used as structural units. In a preferred embodiment there are two depressions and two protrusions constituting two sets which, within the scope of the invention could each be comprised of a plurality of protrusions having any geometric shape limited only by the criterion that the shape must be capable of mating with a matching depression or female receptacle. Thus a block could be created with a single bottom cavity dimensioned to accommodate a plurality of protrusions from mating blocks or a plurality of cavities to accommodate the mating blocks. For ease of presentation, each geometrical shape is presented in this patent as a single circular shape. The two sets are positioned on respective halves of the block surface in a mirror image arrangement calculated to allow a plurality of blocks to be arranged in an overlapping interlocking structure as illustrated in FIG. 7.

FIG. 4 is a bottom view of a container block which illustrates one-half of the block cut away to more clearly depict the circular depressions 28 and protrusions 29. FIG. 4 also illustrates an alternative dispensing means. In this embodiment, the pressure responsive valve 11 of FIGS. 1 and 2 has been replaced with a simple screw cap 21. The cut-away portion of the container block indicates a typical wall thickness 31 which may be achieved by using a material which has significant thermal barrier properties so that when used as a container, the device will keep beverages hot or cold and when used as a structural element, it will provide insulation for the ultimate structure.

FIG. 5 illustrates a plurality of containers as they are normally stacked for storage with the dispensing means 21 in an upright position as it would be during filling operations. Note that the sides of the container block are touching as the result of the male/female joining of the depressions 18 and projections 19 on opposite sides of each container. This creates an interlocked structure which simplifies storage, shipping and handling.

Figure 6:
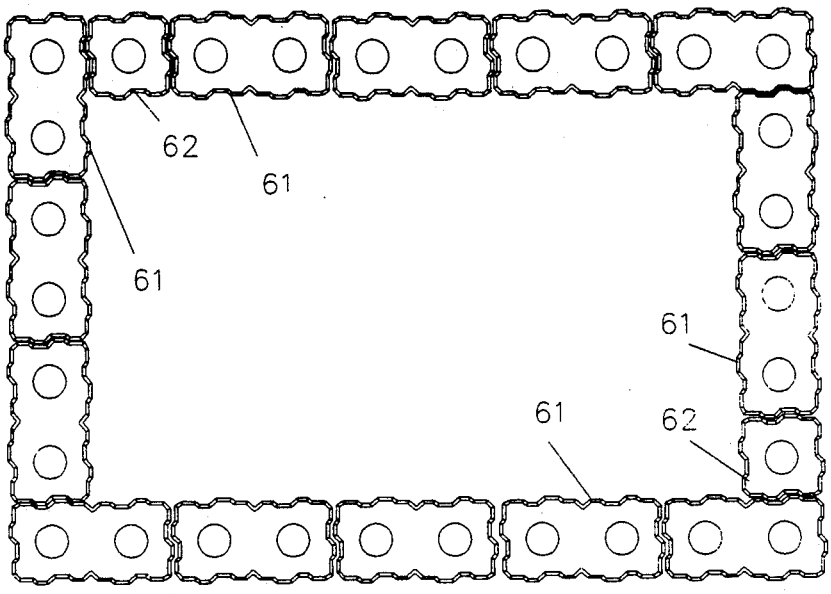
FIG. 6 is a top view of a plurality of container blocks illustrating the various ways in which the sides interfit to form a structure comprised of a plurality of units.

FIG. 6 is a plan view of a single course of container blocks used as structural units. Note that the interfitting geometries of the sides of the blocks facilitates interlocking of both whole 61 and half 62 blocks to allow fabrication of a structure using full and half units as is the normal practice in masonry arts.

FIG. 7 is a side view of a plurality of courses constructed from container blocks. Note that the container blocks overlap to form an interfitting, locking structure where the depressions 28 of two adjacent container blocks receive the two projections 29 of a single container of the next course.

To increase the strength of the structure, the container blocks may be filled with material before assembly. They can be filled with a variety of materials to meet design requirements such as concrete 71 for strength, a blown plastic 72 for thermal properties and rigidity, a fibrous aggregation 73 for thermal properties, or a radiation barrier material 79 of a settable solid, particulate or fluid nature. They may be filled with a settable resinous material 75 to allow fasteners such as nails 76 or dry wall screws 77 to be used to secure panels 78 to the structure.

Panels 78 may also be secured to the container block structure with adhesives or screw type fasteners. For additional strength, the container blocks may be bonded together by suitable adhesives or welding solvents.

Figure 8:
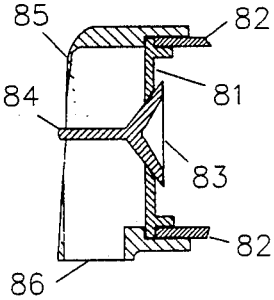
FIG. 8 is an exemplary valve discharge means for the container block with the valve in the closed position.

FIG. 8 is a cut-away view of the dispensing valve illustrated in conjunction with the container block shown in FIGS. 1 and 2. This valve includes a valve seat 81 which is secured to a projection 82 in the wall of the container block. A poppet valve 83 fills the valve seat to seal the contents within the container. An extension 84 on the base of the poppet valve is secured to a cover spout 85 which completely encircles the valve seat 81 and projection of the container 82. The cover spout 85 is resilient and cooperates with the poppet valve stem 84 to hold the poppet valve in a closed position. The spout cover 85 also includes an opening 86 along one edge which acts as a pouring guide when the valve is open.

Figure 9:
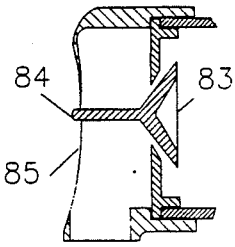
FIG. 9 is an exemplary valve discharge means for the container block with the valve in the opened position.

FIG. 9 illustrates the push responsive valve in the open position. Note that pressure on the top of the cover spout 85 forces the poppet valve support 84 towards the container to open the valve 83 and allow fluid to be discharged from the container.

While preferred embodiments of this invention have been illustrated and described, variations and modifications may be apparent to those skilled in the art. Therefore, I do not wish to be limited thereto and ask that the scope and breadth of this invention be determined from the claims which follow rather than the above description.

What I claim is.

1. A container comprising:

a first side comprising a plurality of parallel offset planes interconnected to form a continuous surface having a first geometric shape;

a second side comprising a plurality of parallel offset planes interconnected to form a continuous surface having a second geometric shape which comprises an interfitting surface to said first geometric shape;

a third side comprising a plurality of parallel offset planes interconnected to form a continuous surface including said first geometric shape;

a fourth side comprising a plurality of parallel offset planes interconnected to form a continuous surface including said second geometric shape;

a fifth side including a flat surface with a projecting geometric shape; and a sixth side including a flat surface with a recess formed therein dimensioned as an antithesis of said projecting geometric shape for receiving projections dimensioned identically to said projecting geometric shape.

2. A container as defined in claim 1, wherein:

said third side comprises first and second sets of said plurality of parallel offset planes interconnected to form a continuous surface comprising two sets of said first geometric shape; and said fourth side comprising first and second sets of said plurality of parallel offset planes interconnected to form a continuous surface comprising two sets of said second geometric shape.

3. A container as defined in claim 1 wherein said container is filled with a particulate material .

4. A container as defined in claim 1 wherein said container is filled with a settable compound.

5. A container as defined in claim 1 wherein said container is filled with a liquid.

6. A container as defined in claim 1 wherein said container is filled with a radiation barrier.

7. A structure comprised of a plurality of interlocked container blocks each of which comprise:

a first side comprising a plurality of parallel offset planes interconnected to form a continuous surface having a first geometric shape;

a second side comprising a plurality of parallel offset planes interconnected to form a continuous surface having a second geometric shape which comprises an interfitting surface to said first geometric shape;

a third side comprising a plurality of parallel offset planes interconnected to form a continuous surface including said first geometric shape;

a fourth side comprising a plurality of parallel offset planes interconnected to form a continuous surface including said second geometric shape;

a fifth side including a flat surface with a projecting geometric shape; and a sixth side including a flat surface with a recess formed therein dimensioned as an antithesis of said projecting geometric shape for receiving projections dimensioned identically to said projecting geometric shape.

8. A structure as defined in claim 7 wherein said container blocks are bonded together.

9. A structure as defined in claim 7, including a panel secured to said structure.

10. A structure as defined in claim 9 wherein said panel is secured to said structure by nails.

11. A structure as defined in claim 9 wherein said panel is secured to said structure by screw means.

12. A structure as defined in claim 9 wherein said panel is secured to said structure by adhesive.

13. A shipping and storage container designed to be used alternately as a construction unit block, comprising:

a plurality of side elements each including a plurality of parallel offset planes interconnected to form a continuous surface;

said side elements connected end-to-end to form a continuous closed surface wherein said side elements on opposite sides of said continuous closed surface present interfitting geometric surfaces facing out from the center of said continuous closed surface.

14. A container as defined in claim 13 including a first side normal to said plurality of side elements, said first side including a protruding structure means for connecting said block to a structure including a female receptacle for said protruding structure means; and a second side opposite said first side including a recess dimensioned to receive male coupling means dimensioned identically to said protruding structure means.

15. A container as defined in claim 13 wherein said block is filled with cement.

16. A container as defined in claim 13 wherein said block is filled with a particulate material.

17. A container as defined in claim 13 wherein said block is filled with a settable compound.

18. A container as defined in claim 13 wherein said block is filled with a liquid.

19. A container as defined in claim 13 wherein said block is filled with a radiation barrier.

20. A structure comprised of a plurality of interlocked container blocks bonded together, each of which comprise:

a plurality of side elements each including a plurality of offset parallel planes interconnected to form a continuous surface;

said side elements connected end-to-end to form a continuous closed surface wherein said side elements on opposite sides of said continuous closed surface present interfitting geometric surfaces facing out from the center of said continuous closed surface;

a first side normal to said plurality of side elements, said first side including a protruding structure means for connecting said container block to a structure including a female receptacle for said protruding structure means;

a second side opposite said first side including a recess dimensioned to receive male coupling means dimensioned identically to said protruding structure means; and a panel secured to said structure.

21. A structure as defined in claim 20 wherein said panel is secured to said structure by nails.

22. A structure as defined in claim 20 wherein said panel is secured to said structure by screw means.

23. A structure as defined in claim 20 wherein said panel is secured to said structure by adhesive.

24. A method for building a structure from a plurality of container blocks containing a product, including the steps of:

removing said product from said plurality of container blocks configured with interlocking offset parallel plane surfaces; and interlocking said offset parallel plane surfaces of said container blocks to form said structure.

25. A method for building a structure as defined in claim 24, wherein said step of interlocking said container blocks includes the step of rotating container blocks so that interfitting side configurations are juxtaposed.

26. A method for building a structure as defined in claim 25, including the step of arranging successive tiers of container blocks in an overlapping staggered orientation where one container block covers one-half of two adjoining container blocks in an adjacent tier.

27. A method for building a structure as defined in claim 26, including the step of securing a panel to the sides of a plurality of interlocked container blocks.

28. A container block, comprising:

a plurality of side elements connected end-to-end to form a continuous closed surface wherein said side elements on opposite sides of said continuous closed surface present mating surfaces facing out from the center of said continuous closed surface;

a first side normal to said plurality of side elements, said first side including a protruding structure means for connecting said container block to a structure including a female receptacle for said protruding structure means;

a second side opposite said first side including a recess dimensioned to receive male coupling means dimensioned identically to said protruding structure means; and said protruding structure means includes even numbered sets of protrusion arranged on said first side as mirror images, each of said sets occupying an area of said first side comprising one half of said block.

29. A container block as defined in claim 28 wherein said side elements are dimensioned to create said container block with a length-to-width ratio of 2 to 1.

30. A container block as defined in claim 29 wherein said protruding structure means includes even numbered sets of protrusion arranged on said first side as mirror images, each of said sets occupying an area of said first side comprising one half of said block.

31. A container block as defined in claim 30 wherein said container block is filled with cement.

32. A container block as defined in claim 30 wherein said container block is filled with a particulate material.

33. A container block as defined in claim 30 wherein said container block is filled with a settable compound.

34. A container block as defined in claim 30 wherein said container block is filled with a liquid.

35. A container block as defined in claim 30 wherein said container block is filled with a radiation barrier.

36. A structure comprised of a plurality of interlocked container blocks, each of which comprise:

a plurality of side elements connected end-to-end to form a continuous closed surface wherein said side elements on opposite sides of said continuous closed surface present mating surfaces facing out from the center of said continuous closed surface;

a first side normal to said plurality of side elements, said first side including a protruding structure means for connecting said container block to a structure including a female receptacle for said protruding structure means;

a second side opposite said first side including a recess dimensioned to receive male coupling means dimensioned identically to said protruding structure means;

said protruding structure means includes even numbered sets of protrusion arranged on said first side as mirror images, each of said sets occupying an area of said first side comprising one half of said block; and said side elements are dimensioned to create said container block with a length-to-width ratio of 2 to 1.

37. A structure as defined in claim 36 wherein said container blocks are bonded together.

38. A structure as defined in claim 36, including a panel secured to said structure.

39. A structure as defined in claim 38 wherein said panel is secured to said structure by nails.

40. A structure as defined in claim 38 wherein said panel is secured to said structure by screw means.

41. A structure as defined in claim 38 wherein said panel is secured to said structure by adhesive.

* * * * *